US006608265B2

(12) United States Patent
Shinkawa

(10) Patent No.: US 6,608,265 B2
(45) Date of Patent: Aug. 19, 2003

(54) SWITCH BOX FOR VEHICLE DOOR LOCK DEVICE

(75) Inventor: Masaki Shinkawa, Yamato (JP)

(73) Assignee: Harada Industry Co., Ltd., Tokyo (JP)

( * ) Notice: Subject to any disclaimer, the term of this patent is extended or adjusted under 35 U.S.C. 154(b) by 0 days.

(21) Appl. No.: 10/141,840

(22) Filed: May 9, 2002

(65) Prior Publication Data

US 2002/0175061 A1 Nov. 28, 2002

(30) Foreign Application Priority Data

May 9, 2001 (JP) ..... 2001-138727

(51) Int. Cl.[7] ..... H01H 9/00; E05C 3/16

(52) U.S. Cl. ..... 200/61.64; 200/61.62; 200/293; 200/318; 200/302.1; 292/216; 292/337

(58) Field of Search ..... 200/61.62, 61.64, 200/61.67, 61.68, 293, 318, 302.1; 70/264, 279.1, 277; 292/201, 216, 337

(56) References Cited

U.S. PATENT DOCUMENTS 5,516,167 A * 5/1996 Hayakawa et al. ..... 292/337
5,678,869 A * 10/1997 Yoshikuwa ..... 292/216
5,746,076 A * 5/1998 Inoue ..... 70/277
6,264,253 B1 * 7/2001 Takaishi ..... 292/216
6,419,286 B1 * 7/2002 Szablewski ..... 292/216

FOREIGN PATENT DOCUMENTS

JP 08326387 A 12/1996 ..... E05B/5/20

* cited by examiner

*Primary Examiner*—Michael Friedhofer
(74) *Attorney, Agent, or Firm*—Pennie & Edmonds LLP

(57) ABSTRACT

A switch box for a vehicle door lock device comprises a slide pin which has one end abutting against a side surface of a latch that engages with and is fixed to the striker and slides in response to a pivot motion of the latch, a slider which is connected and fixed to the other end of the slide pin and on which an elastic slide contact is disposed, a pair of terminals which are short-circuited to be connected to each other by the slide contact depending on a slide position of the slider, and a switch box cover substantially covering them in the lock body case, and the switch box cover has a through hole for ventilation at that position thereof which corresponds to a lower side of one side surface thereof when the switch box cover is attached to the vehicle door.

3 Claims, 7 Drawing Sheets

SWITCH BOX FOR VEHICLE DOOR LOCK DEVICE

CROSS-REFERENCE TO RELATED APPLICATIONS

This application is based upon and claims the benefit of priority from the prior Japanese Patent Application No. 2001-138727, filed May 9, 2001, the entire contents of which are incorporated herein by reference.

BACKGROUND OF THE INVENTION

1. Field of the Invention

The present invention relates to a switch box for a vehicle door apparatus having a powered door lock function.

2. Description of the Related Art

FIGS. 1 and 2 show the arrangement of part of a vehicle door lock device having a powered door lock function (see Jpn. Pat. Appln. KOKAI Publication No. 8-326387). Referring to FIGS. 1 and 2, a recess 2 is formed in the lower portion of the front surface of a synthetic-resin body 1 of the door lock device. A latch 3 and ratchet 4 are pivotally supported in the recess 2 by shafts 5 and 6, respectively.

The latch 3 is biased counterclockwise in FIG. 1 by a spring (not shown). Upon a door closing operation, when the latch 3 engages with a striker 7 fixed to the car body, it rotates counterclockwise. Hence, the latch 3 rotates to its full-latch state through a state (a so-called half-latch state) where it engages with its half-latch stepped portion 8.

A switch 34 is provided to abut against the side surface of the latch 3. The switch 34 detects the full-latch state of the latch 3 which engages with the striker 7 fixed to the car body side when the door is closed.

The switch 34 has an electrical switch mechanism which is ON when the latch is in the full-latch state. As shown in FIG. 1, most of the switch 34, excluding one end of its pin abutting against the side surface of the latch 3, is housed in an actuator housing chamber 20 which houses a powered actuator unit 17 (to be described later).

The actuator housing chamber 20 is surrounded by a base case 18 and a cover case (not shown). The base case 18 is integrally formed with the upper portion of the body 1. The cover case is fixed to the base case 18.

A lock lever (not shown) is axially supported by the latch shaft 5 and is switched between a lock position and unlock position. The actuator unit 17 in the actuator housing chamber 20 switches this lock lever between the lock position and unlock position.

FIG. 2 is a view schematically showing the actuator unit 17 housed in the actuator housing chamber 20 together with the switch 34. A gear 22 is fixed to the rotating shaft of a motor 21. A gear disk 23 meshes with the gear 22.

The gear disk 23 has a small-diameter gear 24 coaxial with it. A sector gear 25 rotatably axially supported by a shaft 26 meshes with the small-diameter gear 24.

The sector gear 25 is held at a neutral position at the center by a spring (not shown). When the motor 21 rotates in the forward or reverse direction, the sector gear 25 rotates clockwise or counterclockwise.

A projection 28 is formed on the distal end of a change lever 27 fixed to the shaft 26. The projection 28 engages with a wide recess 29 of the sector gear 25 with a lost motion linkage.

One end of the shaft 26 projects outward through the shaft hole of the cover case, and an output gear is fixed to this projecting portion. The output gear meshes with a gear portion formed on the lock lever.

The gear 22 fixed to the rotating shaft of the motor 21 rotates in the forward or reverse direction to rotate the gear disk 23. Then, the small-diameter gear 24 integrally formed with the gear disk 23 rotates the sector gear 25 within a predetermined range from the neutral position at the center.

Thus, the projection 28 of the change lever 27 engaging with the large-width recess 29 with the lost motion linkage engages with the sector gear 25 over the lost motion linkage and is rotated by it. Then, an output gear 31 fixed to the other end of the shaft 26 of the change lever 27 is rotated to pivot a lock gear 14 through its gear portion 32.

Therefore, the forward/reverse rotation of the motor 21 is transmitted to the lock lever (not shown) through a mechanism in the actuator unit 17. Thus, the lock lever is switched from the lock position to the unlock position or vice versa. After this, power supply to the motor 21 is ended and the rotational torque of the motor 21 disappears. Then, the sector gear 25 is automatically restored to the neutral position at the center by the elasticity of the spring.

As described above, the switch 34 is housed in the actuator housing chamber 20 together with the actuator unit 17. The distal end of the projecting pin of the switch 34 abuts against the side surface of the latch 3.

In the switch 34, one end of the pin biased by the spring projects to abut against the side surface of the latch 3, as described above. The other end of the pin is connected to an electrical contact piece which is ON when the latch 3 is in the full-latch state.

Since a vehicle door lock device is attached and fixed to the inner side of the steel plate of a vehicle door, it is adversely affected by the atmospheric temperature more easily than various types of components provided in the vehicle compartment.

The switch 34 is housed in the actuator housing chamber 20 together with other actuator unit 17 and the like. However, since the switch 34 particularly has an electric contact or the like, it may result in an operation failure due to dew condensation or the like.

BRIEF SUMMARY OF THE INVENTION

It is an object of the present invention to provide a switch box for a vehicle door lock device, in which the adverse influence of dew condensation and the like caused by a temperature change is eliminated as much as possible so the operating state of a latch can be reliably detected under any condition.

A switch box for a vehicle door lock device for a vehicle door lock device, which is integrally housed in a lock body case and engages with and is fixed to a striker of a vehicle door, according to one aspect of the present invention is characterized by comprising: a slide pin which has one end abutting against a side surface of a latch that engages with and is fixed to the striker of a vehicle, and which slides in response to a pivot motion of the latch when biased by a spring; a slider which is connected and fixed to the other end of the slide pin and on which an elastic slide contact is disposed; a pair of terminals which are short-circuited to be connected to each other by the slide contact depending on a slide position of the slider; and a switch box cover which substantially hermetically covers most of the slide pin, excluding one end thereof abutting against the side surface of the latch, the spring, the slider, and the terminals in the lock body case, and the switch box cover has a through hole for ventilation at that position thereof which corresponds to a lower side of one side surface thereof when the switch box cover is attached to the vehicle door. The adverse influence of dew condensation and the like caused by a temperature change is eliminated as much as possible, so the operating state of the latch can be reliably detected under any condition.

Preferred manners of the switch box for a vehicle door lock device described above are as follows. The following manners may be used alone each, or may be appropriately combined.

(1) A path extending from the through hole for ventilation to an interior of the switch box is bent. The possibility that water may enter the switch box directly by any chance can be minimized.

(2) The switch box cover further has a through hole for drainage at that position thereof which corresponds to a lowermost end of one side surface of the switch box cover when the switch box cover is attached to the vehicle door. Water in the switch box can be drained immediately.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A vehicle door lock device according to an embodiment of the present invention will be described with reference to the accompanying drawings.

Figure 1:
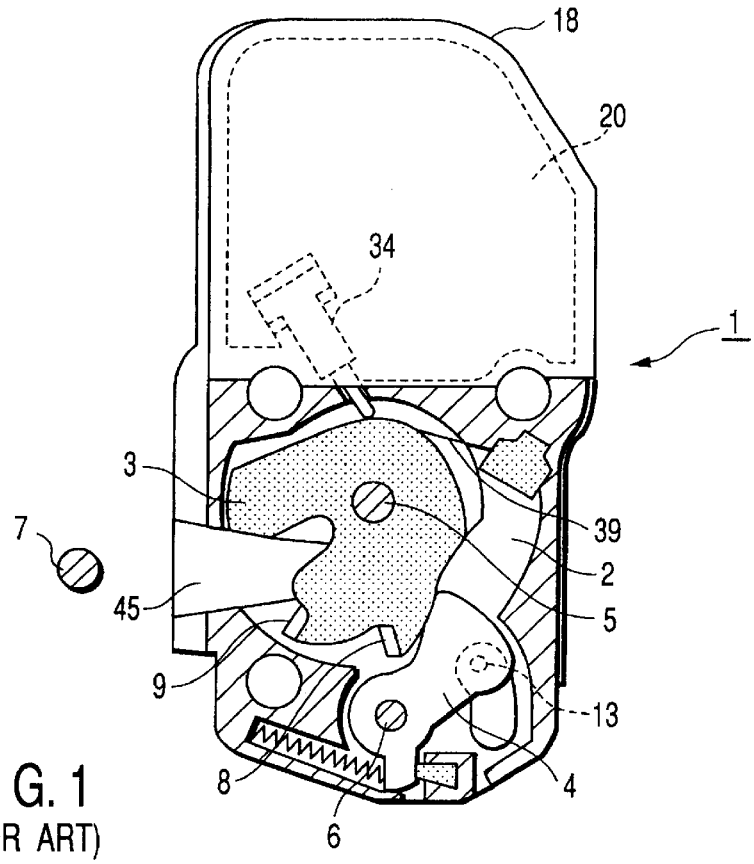
FIG. 1 (PRIOR ART)
FIG. 1 is a cross-sectional plan view showing the arrangement of mainly a latch, ratchet, and car body striker in a conventional door lock device.
Figure 2:
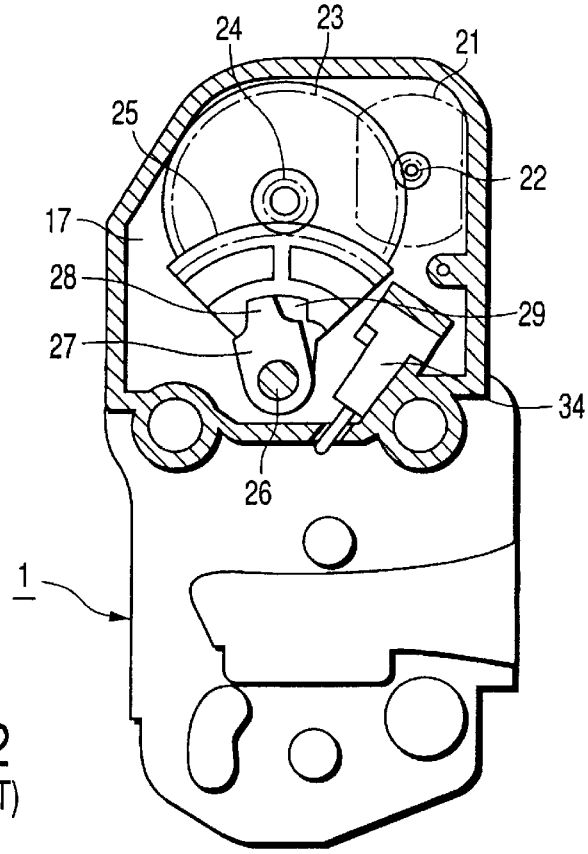
FIG. 2 (PRIOR ART)
FIG. 2 is a cross-sectional plan view showing the arrangement of mainly an actuator unit in the conventional door lock device.
Figure 3:
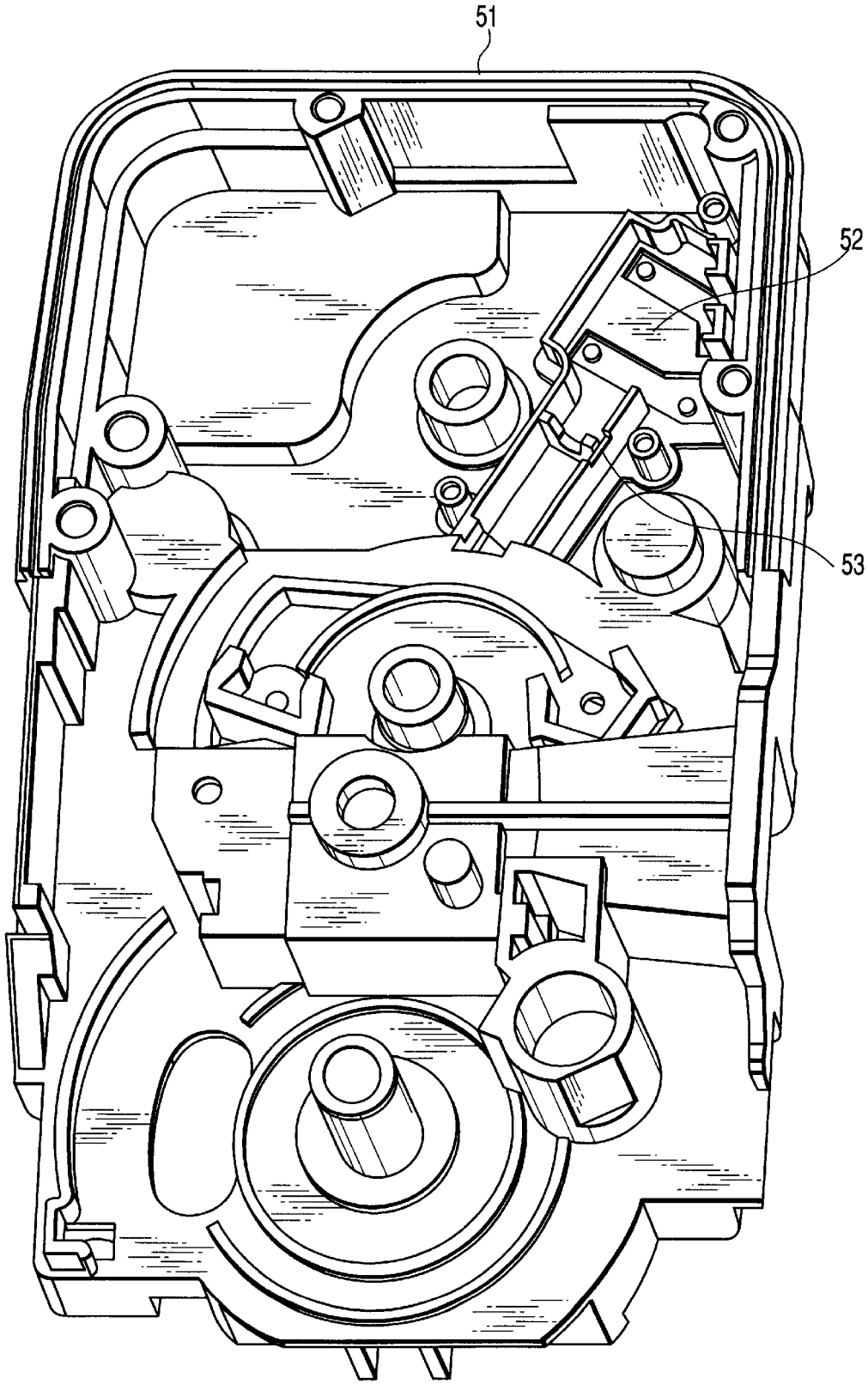
FIG. 3 is a perspective view showing the arrangement of a synthetic-resin body in a vehicle door lock device according to an embodiment of the present invention.

FIG. 3 is a view showing the arrangement of a synthetic-resin body 51 in the vehicle door lock device. As shown in FIG. 3, a switch box lower portion 52 is formed on the inner surface of the synthetic resin body 51 to be integral with it. A notch 53 is formed in part of the side wall of the switch box lower portion 52. The notch 53 forms a vent maze (to be described later).

Figure 4:
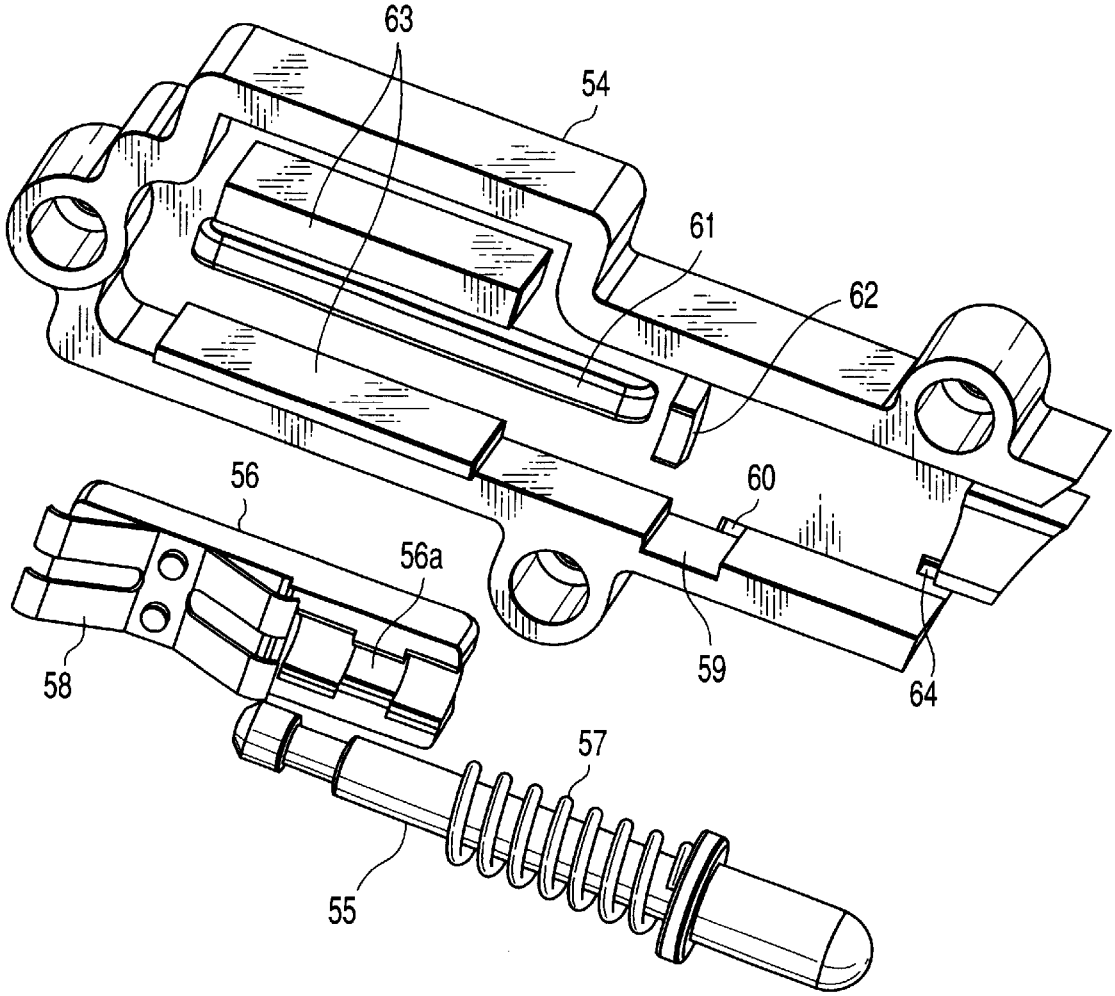
FIG. 4 is a perspective view showing the arrangement of a switch cover, slide pin, and slider.

FIG. 4 is a view showing the arrangement of a switch cover 54, slide pin 55, slider 56, and the like. The switch cover 54 is fitted in the switch box lower portion 52 to form a switch box. The slide pin 55 and slider 56 are sealed in the switch box.

Referring to FIG. 4, one distal end of the slide pin 55 provided in the body 51 forms a hemispherical shape and abuts against the side surface of a latch (not shown). A coiled spring 57 is mounted on the slide pin 55. The other distal end of the slide pin 55 forms a stepped portion. This stepped portion is fitted in a stepped groove 56*a* of the slider 56. Hence, the slide pin 55 and slider 56 integrally slide in the switch box.

The slider 56 is formed of an insulating member. A slide contact 58 is attached and fixed to one side surface of the slider 56. The slide contact 58 has a pair of open legs formed by bending an elastic metal plate.

The switch cover 54 has a thin structure. Thus, part of the side wall of the switch cover 54 which abuts against the notch 53 forms a recess 59 with respect to the surrounding wall surface. The recess 59 has a vent hole 60 at its one end. The vent hole 60 extends to that upper surface of the cover which corresponds to the lower side in FIG. 4.

Assume that the switch box is formed by covering the switch box lower portion 52 with the switch cover 54 such that the inner surface of the side wall of the switch cover 54 abuts against the outer surface of the side wall of the switch box lower portion 52. In this case, the bent vent maze formed of the vent hole 60, recess 59, and notch 53 realizes ventilation between the interior and the outer side of the switch box.

In addition, similarly to the vent hole 60, a drain hole 64 is formed at that position in the switch cover 54 which is in the vicinity of the lowermost end of the switch box when the door lock device is attached to the vehicle door. The drain 64 extends to the upper surface of the cover.

Figure 5:
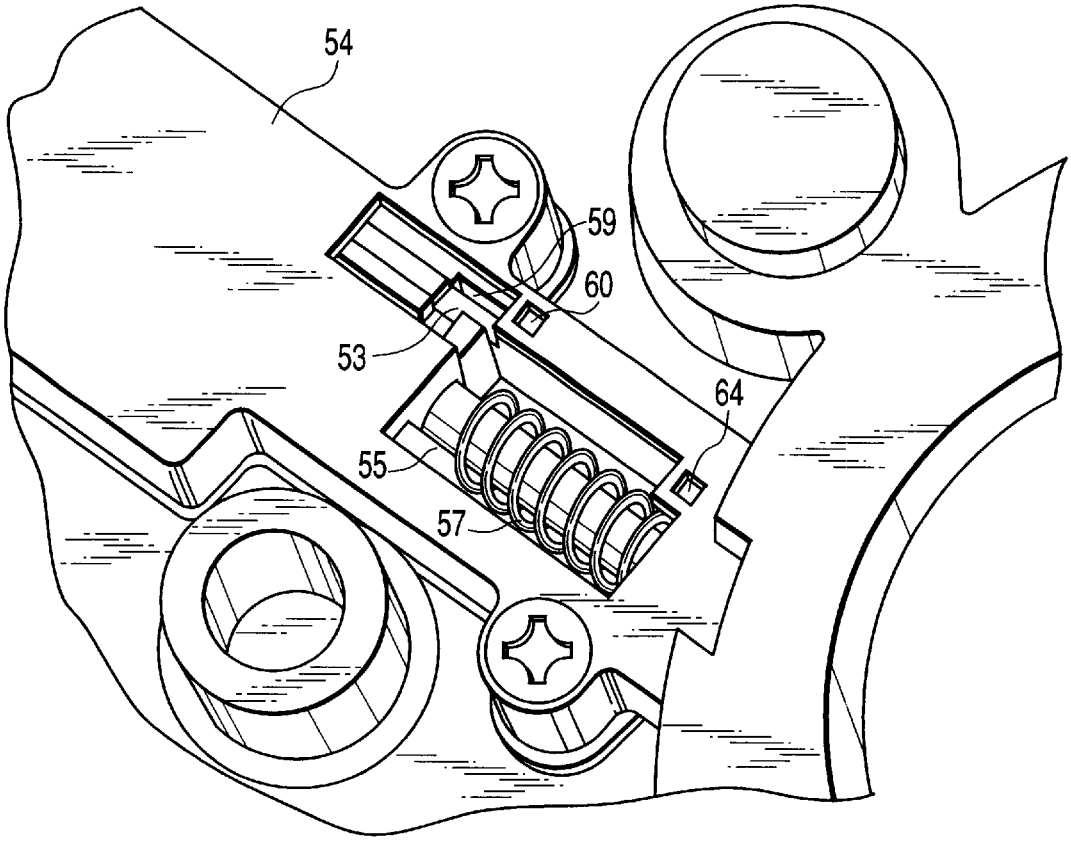
FIG. 5 is a view for explaining a path extending from a vent hole to the interior of a switch box (a portion covered by the switch cover)

A path extending from the vent hole 60 to the interior of the switch box (portion covered by the switch cover) will be described with reference to FIG. 5. The vent hole 60 extending to the upper surface of the switch cover 54 is formed at the end of the recess 59. Thus, the recess 59 is ventilated by the vent hole 60 extending to the upper surface of the switch cover 54. The interior of the switch box communicates with the recess 59 through the notch 53. In this manner, ventilation is ensured in the switch box. The path extending from the vent hole 60 to the interior of the switch box is bent twice, as is apparent from FIG. 5. Therefore, direct entering of water from the vent hole 60 into the switch box can be avoided as much as possible. That portion of the switch cover 54 which is provided with the slide pin 55 communicates with the recess 59 through the notch 53. That portion of the switch cover 54 which is provided with the slide pin 55 has the drain hole 64. Thus, water in the switch box can be discharged immediately.

A protrusion 61 is formed on the inner side of the upper surface of the switch cover 54. The protrusion 61 fits in a groove formed in the lower surface of the slider 56 to define the slide direction of the slider 56. A stopper 62 formed of a protrusion and a pair of terminal retaining protrusions 63 are also formed on the inner side of the upper surface of the switch cover 54. The stopper 62 regulates the slide range of the slider 56. The pair of terminal retaining protrusions 63 are parallel to each other to sandwich the protrusion 61, and press terminals (to be described later) against the inner bottom surface of the switch box lower portion 52.

Figure 6:
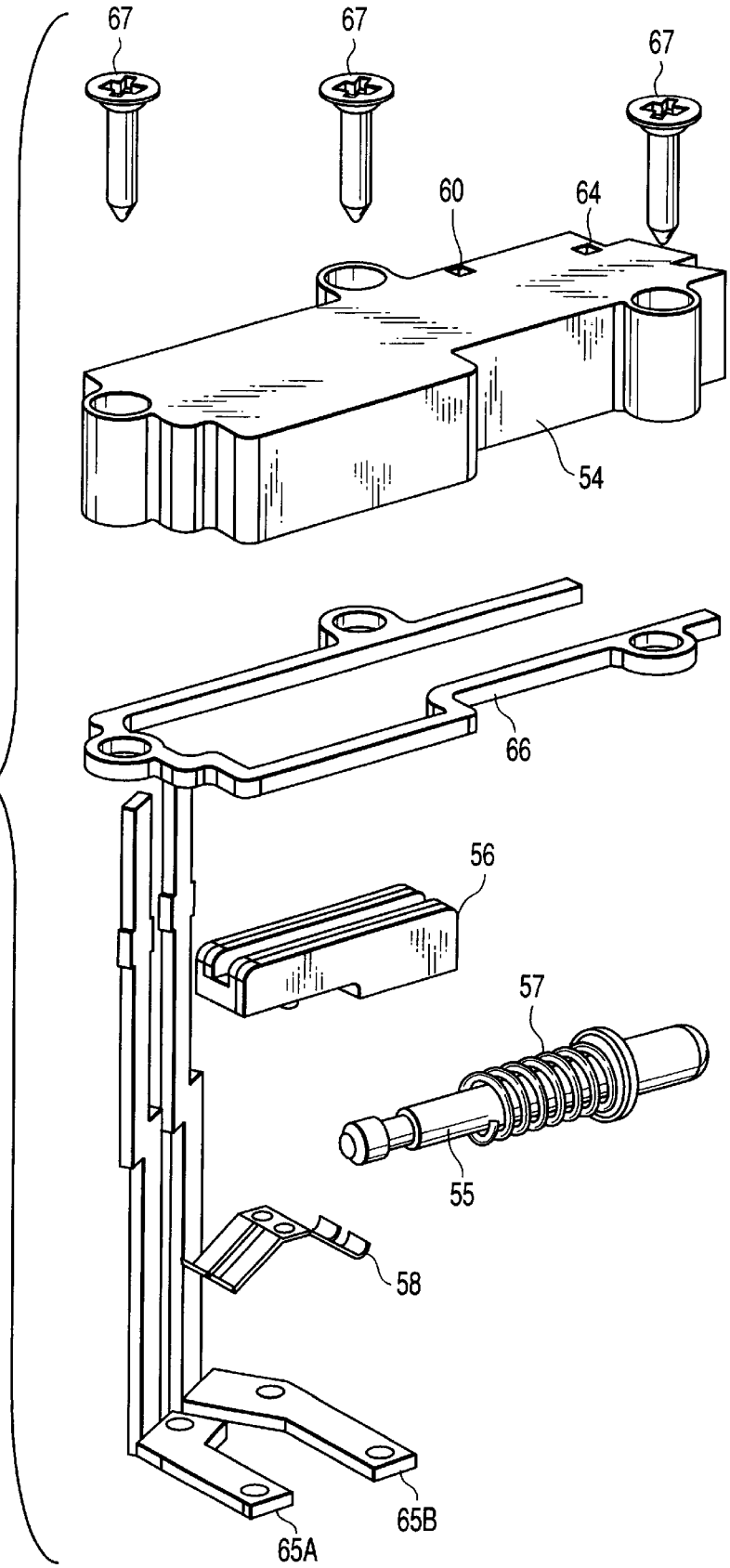
FIG. 6 is a perspective view showing the respective members that form the switch box.

FIG. 6 is an exploded perspective view showing the respective members that are attached to the switch box lower portion 52 to form the switch box.

Figure 7:
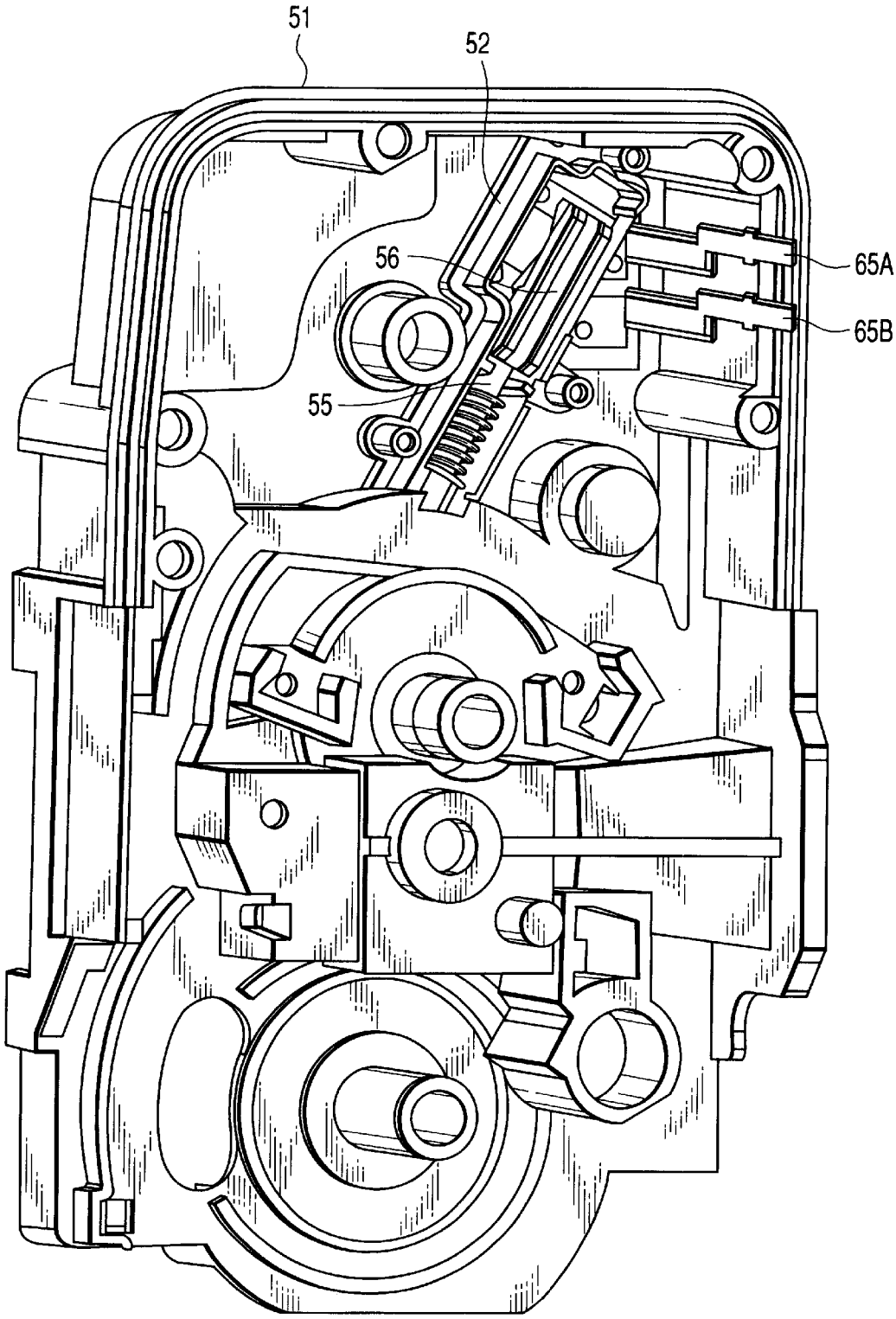
FIG. 7 is a perspective view showing how the slider and slide pin are attached to the lower portion of the switch box.

Terminal grooves are formed in the inner surface of the switch box lower portion 52 shown in FIG. 3. A pair of terminals 65A and 65B formed by bending are fitted in the terminal grooves from below in FIG. 6. The slider 56 and the slide pin 55 are integrally placed above the pair of terminals 65A and 65B, as shown in FIG. 7. The slider 56 has the slide contact 58. The spring 57 is mounted on the slide pin 55.

Figure 8:
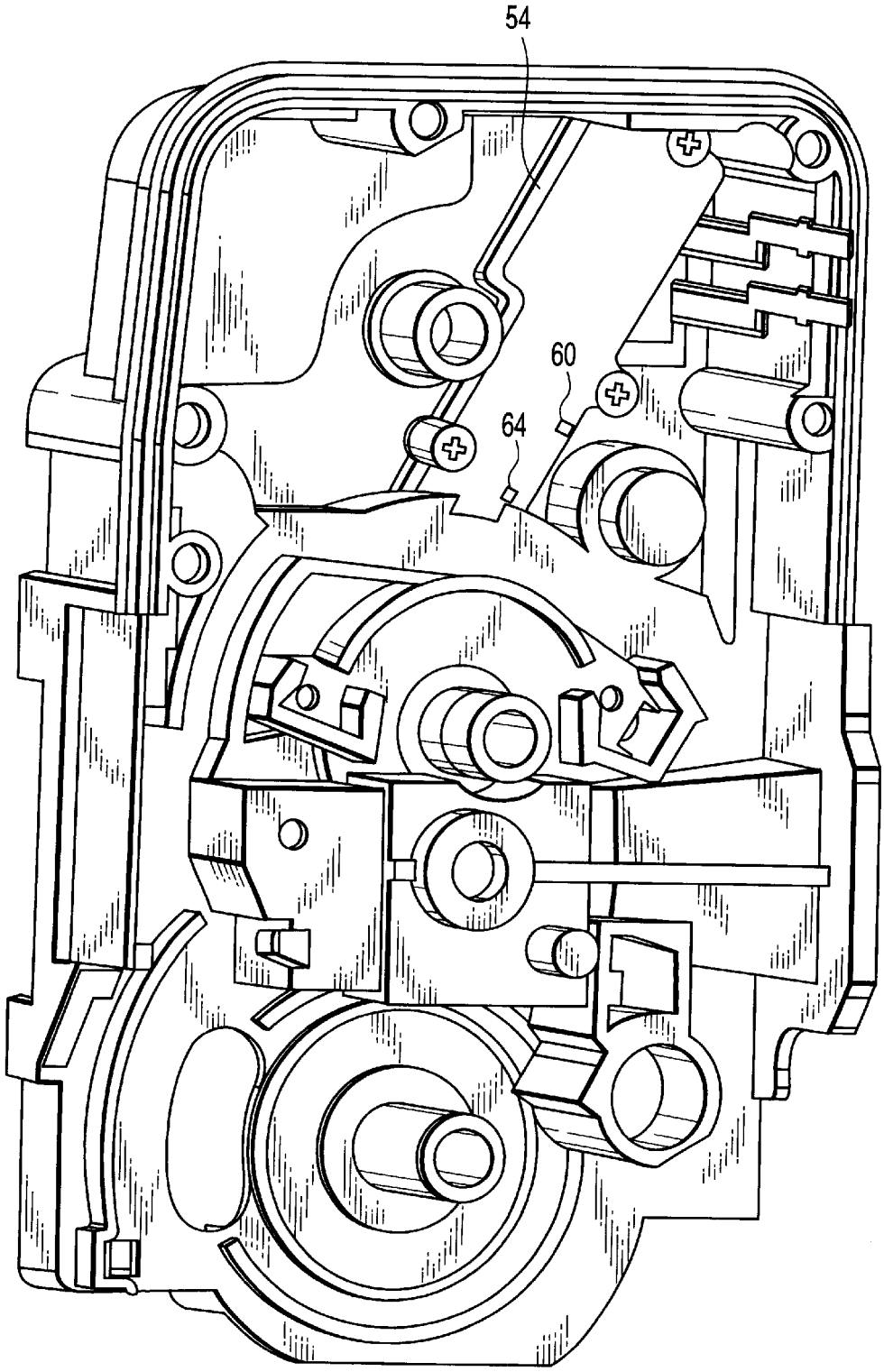
FIG. 8 is a perspective view showing how the switch cover is attached to the lower portion of the switch box.

The switch cover 54 is attached and fixed to the switch box lower portion 52 through a waterproof packing 66 by threadable engagement of, e.g., three set screws 67. Hence, the switch box as shown in FIG. 8 is completed.

One projecting end of the slide pin 55 in the switch box abuts against the side surface of the latch 3 (not shown) upon a biasing operation of the spring 57, as shown in FIG. 7. Thus, the slide pin 55 slides the slider 56 to a position corresponding to the pivoting state of the latch 3. At a slide position where the latch 3 becomes full-latched, the slide contact 58 attached to the slider 56 short-circuits the pair of terminals 65A and 65B.

Therefore, whether or not the latch 3 is in the full-latch state can be known by, e.g., detecting electrical connection between the terminals 65A and 65B from the outside.

In the above arrangement, the switch cover 54 is attached to the switch box lower portion 52 by using the waterproof packing 66 as well. Thus, hermeticity in the switch box is maintained. Also, water and the like can be prevented from entering the switch box from the attaching surface of the switch cover 54.

With an ordinary hermetic structure, when a sharp temperature change or the like occurs, dew condensation may occur in it. According to the present invention, even in such a case, ventilation between the interior and the outer side of the switch box is maintained through the vent hole 60, as shown in FIG. 8. Thus, no large temperature difference occurs. This minimizes the possibility of dew condensation in the switch box. Consequently, the operating state of the latch can be detected reliably.

Particularly, the vent path is formed in a bent manner of the vent hole 60 and recess 59 of the switch cover 54, and the notch 53 of the switch box lower portion 52. This minimizes the possibility of direct water entering into the switch box.

The drain hole 64 is formed at that position of the switch cover 54 which corresponds to the lowermost end when the door lock device according to this embodiment is attached to the vehicle door, as shown in FIG. 8. Hence, even if water should enter the switch box, it can be discharged quickly.

The shapes and the like of the respective components of the present invention are not limited to this embodiment, but can obviously be appropriately modified in accordance with their mutual connection, engaging relationship, and the like.

The present invention is not limited to the embodiment described above, but can be modified and practiced in various manners within a range not departing from the spirit and scope of the invention.

The above embodiments include inventions of various stages, and various types of inventions can be extracted through appropriate combinations of a plurality of disclosed constituent elements. For example, assume that even when several constituent elements are eliminated from all constituent elements shown in the embodiment, at least one of problems described referring to the problems to be solved by the invention can be solved, and at least one of the effects described referring to the effect of the invention can be obtained. In this case, an arrangement from which these several constituent elements are eliminated can be extracted as an invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A switch box for a vehicle door lock device, which is integrally housed in a lock body case and engages with and is fixed to a striker of a vehicle door, comprising:

a slide pin which has one end abutting against a side surface of a latch that engages with and is fixed to the striker of a vehicle, and which slides in response to a pivot motion of the latch when biased by a spring;

a slider which is connected and fixed to an other end of the slide pin and on which an elastic slide contact is disposed;

a pair of terminals which are short-circuited to be connected to each other by the slide contact depending on a slide position of the slider; and a switch box cover which substantially hermetically covers most of the slide pin, excluding the one end thereof abutting against the side surface of the latch, the spring, the slider, and the terminals in the lock body case, wherein the switch box cover has a through hole for ventilation at a position thereof which corresponds to a lower side of one side surface thereof when the switch box cover is attached to the vehicle door.

2. A switch box according to claim 1, wherein a path extending from the through hole for ventilation to an interior of the switch box is bent.

3. A switch box according to claim 1, wherein the switch box cover further has a through hole for drainage at a position thereof which corresponds to a lowermost end of one side surface of the switch box cover when the switch box cover is attached to the vehicle door.

* * * * *